US006792851B1

(12) United States Patent
Schulz

(10) Patent No.: US 6,792,851 B1
(45) Date of Patent: Sep. 21, 2004

(54) APPARATUS AND METHODOLOGY FOR EMBOSSING FIBROUS WEBS CONTAINING CONTAMINANTS

(75) Inventor: Galyn A. Schulz, Greenville, WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/686,210

(22) Filed: Oct. 11, 2000

Related U.S. Application Data

(60) Provisional application No. 60/159,761, filed on Oct. 15, 1999.

(51) Int. Cl.[7] ..... B31F 1/07
(52) U.S. Cl. ..... 101/32; 101/6; 156/209
(58) Field of Search ..... 101/4, 5, 6, 32; 156/209

(56) References Cited

U.S. PATENT DOCUMENTS 5,215,617 A * 6/1993 Grupe ..... 156/209
5,269,983 A 12/1993 Schulz ..... 364/25
5,503,896 A 4/1996 Veith et al. ..... 428/141
5,529,563 A 6/1996 Veith et al. ..... 493/395
5,727,458 A 3/1998 Schulz ..... 101/24

* cited by examiner

*Primary Examiner*—Ren Yan
(74) *Attorney, Agent, or Firm*—Michael W. Ferrell

(57) ABSTRACT

Apparatus and methodology to provide embossing of recycled pulp, which may contain contaminants such as glue or paper particles, without adversely affecting the processing machinery. This enables the recycled pulp to be embossed in a manner similar to that of non-recycled pulp which provides an absorbency, softness and appearance to the finished product which compares favorably to paper products made from non-recycled pulp. The embossing is carried out by matched embossing rollers in which one of the rollers is relatively soft (Shore A hardness of 50–65) and the other roller is relatively hard (Shore A hardness above 90). Recycled pulp, even containing contaminants, may be embossed in this manner without causing excess wear or possible damage to the embossing rollers.

7 Claims, 1 Drawing Sheet

APPARATUS AND METHODOLOGY FOR EMBOSSING FIBROUS WEBS CONTAINING CONTAMINANTS

CROSS-REFERENCE TO RELATED APPLICATIONS

This application claims the benefit of the filing date of U.S. Provisional Patent Application Serial No. 60/159,761, filed Oct. 15, 1999.

TECHNICAL FIELD

The invention relates to embossing of paper products, for example, paper towels, toilet tissue and napkins, in which an improved embossing combination is used which is particularly suitable for the embossing of paper products made from recycled pulp.

BACKGROUND OF THE INVENTION

Paper products, such as paper towels, napkins and toilet tissue are widely used on a daily basis for a variety of household needs. Typically, such products are formed of a fibrous elongated web which is either packaged in rolls or in a folded stack. The fibrous webs are usually embossed to increase the bulk of the tissue and to improve the absorbency, softness and appearance of the product both as individual sheets, and in providing a uniform stack or roll package. Embossing can also aid in holding superposed plies of a web together. A commonly used embossing apparatus includes one or more steel embossing rollers having male protuberances thereon for forming the embossed pattern, and a corresponding steel roller which includes matched or mated female recesses which are a three dimensional mirror image of the male protuberances. The web passes between the nip (gap) of the male and female embossing rollers such that the embossed pattern is imparted to the web.

Recently, environmental concerns have led to the use of greater amounts of recycled pulp in the production of paper products. However the economies of recycling make it practically impossible to remove all contaminants from the recycled pulp. In particular, recycled pulp often contains contaminants such as particles of glue and small pieces of plastic which adhere to the pulp, and which are known as "stickies". These contaminants when passed through the embossing rollers of paper production equipment may adhere to, or become lodged in, the protuberances or recesses of the rollers causing excess wear and possible damage to the embossing rollers, thus negating the savings had from the use of recycled materials. If on the other hand, the clearances embossing machinery are adjusted to accommodate possible contaminants in the recycled pulp, the qualities of the finished paper product may be adversely affected, which will render such recycled pulp based products less commercially attractive.

The present invention is directed to apparatus and methodology to provide embossing of recycled pulp without adversely affecting the processing machinery. This enables the recycled pulp to be embossed in a manner similar to that of non recycled pulp which provides an absorbency, softness and appearance to the finished product which compares favorably to paper products made from non-recycled pulp. It has been found that recycled pulp can be embossed in a manner comparable to that of non-recycled pulp, even if it contains contaminants, if the embossing is carried out by matched embossing rollers in which one of the rollers is relatively soft Shore A (durometer) hardness of 40–65 and the other roller is relatively hard Shore A (durometer) hardness above about 90. The hard roll of the matched set may be a steel roll which is "off" of the Shore A hardness scale. As used herein, the terminology having a Shore A hardness of at least about 90 and the like or "greater than about 90" includes harder surfaces such as steel surfaces whether or not a different hardness scale would be applicable. As one of skill in the art will appreciate, a P&J hardness scale is applicable to steel surfaces. Recycled pulp, even containing contaminants, may be embossed in this manner without causing excess wear or damage to the embossing rollers.

As used herein a matched set of embossing rollers means that the male embossing elements, carried by one roller, are engraved first and the female elements carried by the other rollers are subsequently made from the male elements, or vice versa, so that both elements are virtually inverse or reciprocal images of each other within the practicalities of manufacturing tolerances. This is in contrast to "nnmatched" embossing rollers in which the male and female embossing elements are not identical in shape, but still are positioned relative to each other in registry such that they engage.

It is an object of the present invention to provide apparatus and methodology for embossing webs that will avoid damage to the processing machinery should the web contain contaminating particles.

It is an object of the present invention to provide apparatus and methodology for embossing paper products that will permit processing of recycled pulp without causing excess wear or damage to the processing machinery.

It is an object of the present invention to provide apparatus and methodology for embossing paper products that will permit older embossing machinery having matched embossing rollers to be retrofitted with a matched roller that can accommodate pulp that may contain contaminants, such as recycled pulp.

BACKGROUND ART

U.S. Pat. Nos. 5,503,896 and 5,529,563, both to Veith et al., disclose methods for embossing webs using unmatched male and female embossing elements which are preferably made by laser engraving rubber embossing rolls (see, e.g., col. 3, lines 49–52 of U.S. Pat. No. 5,503,896). The male and female embossing elements can be made of different materials. For example, the male elements can be made of steel, and the female elements can be composed of a deformable material, such as rubber, or vice versa (see, e.g., col. 4, lines 3–5 of U.S. Pat. No. 5,503,896). The web can be any web suitable for embossing, including paper, tissue, nonwoven, films, laminates, combinations thereof and the like (see, e.g., col. 4, lines 10–13 of U.S. Pat. No. 5,503,896).

U.S. Pat. No. 5,727,458 to Schulz (the inventor herein) discloses an embossing method wherein two plies of web material are multilevel embossed between rigid engraved embossing rolls and backup embossing rolls. The backup embossing rolls can be composed of laser engraved rubber (see, e.g., col. 3, line 64 and col. 4, lines 56–57 and 67). The non-backup embossing rolls are generally composed of steel but may be substituted with laser-engraved rubber rolls (col. 4, lines 16–21). The backup embossing rolls may have a mirror image engraving of the embossing pattern on the non-backup embossing rolls (col. 4, lines 64–66). The embossing method can be used to make toilet tissue and paper towels (col. 3, lines 53–54).

U.S. Pat. No. 5,269,983 to Schulz (the inventor herein) describes a method of embossing involving a mated pair of resilient and rigid embossing rolls. According to the '983 patent a laser can be utilized to form recesses in a resilient roll such that the resilient roll receives protuberances of a rigid male embossing roll when the rolls are placed in contact

BRIEF DESCRIPTION OF THE DRAWINGS

For a better understanding of the invention reference is made to the following drawings which are to be taken in conjunction with the detailed description to follow.

DESCRIPTION OF THE PREFERRED EMBODIMENTS

Figure 1:
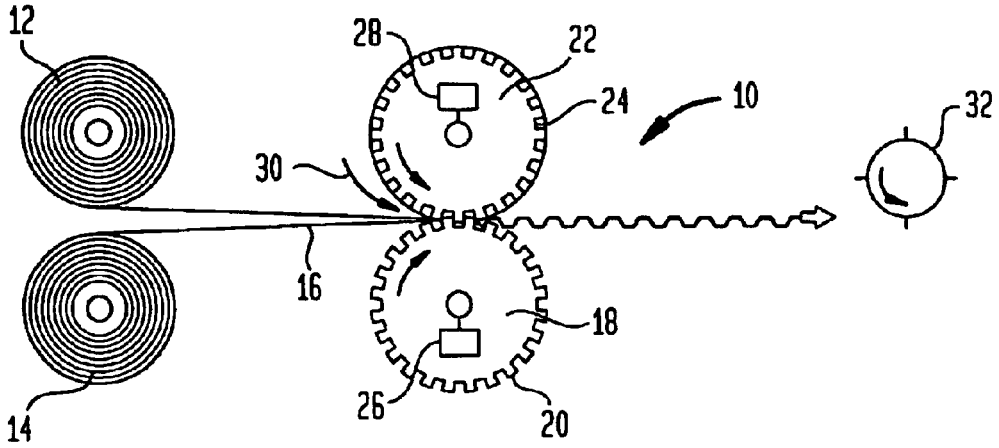
FIG. 1 is a side view of a paper product embossing apparatus in accordance with the present invention.

FIG. 1 illustrates the embossing apparatus 10 of the present invention which is includes a pair of supply rolls 12, 14 which supply the fibrous web to be embossed. While a pair of supply rolls is shown, to form a two-ply web 16, it is to be understood that multiple supply rolls may be provided for any desired number of plies or a single roll may be utilized to provide a single ply web or a multi-ply web in which the plies have been previously joined. A first embossing roller 18 is provided which has a "hard" outer surface having a plurality of protuberances 20 corresponding to the desired embossing pattern. The protuberances 20 are shown representatively, and may take any desired form, shape or number in accordance with the present invention. A second "soft" embossing roller 22 is provided having a deformable outer surface with female portions or recesses 24 provided which are matched to the embossing pattern of the protuberances 20, such that as the rolls 18,22 are in rolling engagement, the protuberances 20 of the rigid roll enter the recesses 24 of the resilient roll. The hard and soft rolls thus cooperate to form the embossed pattern on the web. A hydraulic system may be provided as shown schematically by blocks 26,28 to allow for separation of the rolls, for example, to allow initial feeding and registration of the web between the rolls, and to urge the rolls together for the embossing operation. A nip 30 is formed between rollers 18,22 and can be adjusted by the hydraulic systems 26,28. Web 16 after being embossed, may then proceed to further web processing machinery such as a perforation roller 32.

In accordance with the present invention it has been found that if one of the matched pair of embossing rollers is formed from material that is less hard than the material of the other embossing roller, webs containing contaminants can be embossed without excess wear or damage to the embossing rollers. Specifically, the "hard" roller should have a Shore A hardness greater than about 95 (including steel), preferably 95–99 for laser engraved rolls. The "soft" roller should have a Shore A hardness of 40–95 and preferably in some embodiments 40–85 or 40–75 or even more preferably 40–65. The particular material used for either roller is not critical, for example, the hard roller could be steel, or a hard rubber or plastic. The soft roller is preferably natural rubber but can also be synthetic rubber or plastic. A Shore A hardness of 60–65 is particularly useful in some embodiments. A natural rubber can readily be made into a mirror image of the other roller by a laser process to "read" the protuberances or recesses and "burning" away the rubber. Such a process is described in U.S. Pat. No. 5,269,983 issued to Schulz (the inventor herein), the disclosure of which is hereby incorporated by reference as if fully set forth herein.

In a particularly preferred method of the invention, there is provided a method for embossing a fibrous web containing contaminants to improve the bulk and softness of the web by passing the web through a nip formed by a pair of rotating rollers, wherein the contaminants will not damage the rollers, the method comprising the steps of a) providing a first embossing roller having an outer surface, said outer having a plurality of male protuberances thereon corresponding to a desired embossed pattern; b) providing a second embossing roll having an outer surface having a plurality of female recessed portions which are matched to the male protuberances of the first roll; c) wherein at least one of said first and second embossing rollers is a laser engraved roller and has a Shore A hardness from about 40–95; and d) placing the rolls in contact to form a nip between the rolls, with the protuberances of the first roll entering the recesses of the second roll as the rolls rotate together; and passing a fibrous web through the nip formed by the rolls to emboss the web wherein the roller having the Shore A hardness of 40 will deform if any contaminants are encountered in the fibrous web. More typically, at least one roller will have a Shore A hardness of from 40–85 or 40–75 with perhaps a Shore A hardness of from 40–65 being particularly preferred.

Figure 2A:
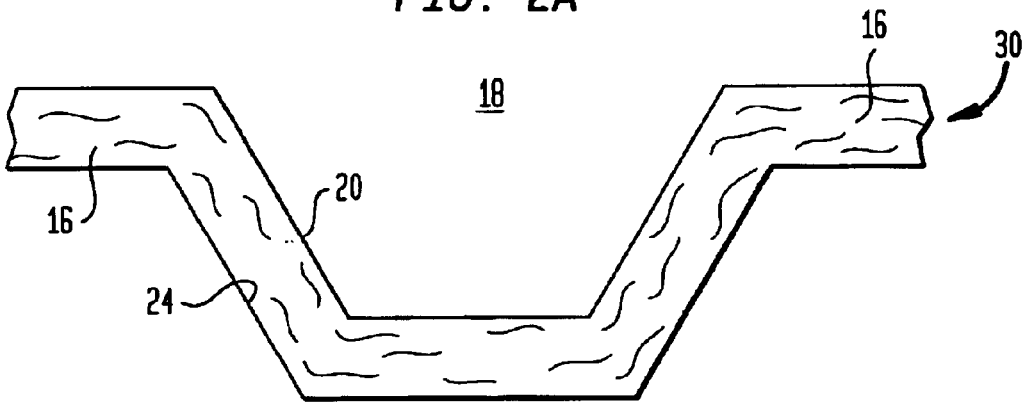
FIGS. 2*a* and 2*b* illustrate the nip between the processing rollers with FIG. 2*a* showing the embossing of a portion of a web that is free of contaminating particles and FIG. 2*b* showing the embossing of a portion of a web that includes a contaminating particle.
Figure 2B:
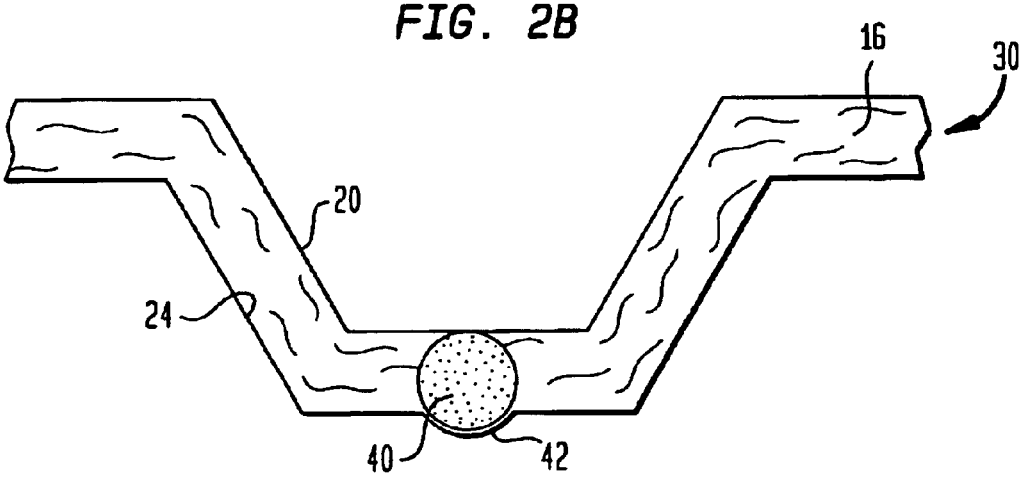

FIGS. 2*a* and 2*b* illustrate nip 30 between rollers 18, 22 as they act on web 16. In FIG. 2*a* the portion of web shown 16 is free of any contaminants, it is seen that web 16 is embossed between the protuberances 20 of roller 18 and the recesses of roller 24 as web 16 is deflected therebetween, with the gap defined as the distance between rollers 18, 22. In FIG. 2*b* the portion of web shown 16 includes a contaminating particle 40, such as a particle of glue or plastic, it is seen that web 16 is again deflected between the protuberances 20 of roller 18 and the recesses of roller 24, however particle 40, which may be non-compressible, will also be lodged between protuberance 20 and recess 24. However, as roller 22 is formed from deformable material a temporary recess 42 will be formed in recess 24 of roller 22 which permits particle 40 to pass without damaging rollers 18,22. If both rollers were formed from harder material contaminants would easily damage, or become lodged in, the rollers.

From the point of view of the operation of the present invention it is irrelevant whether the soft roller is the male roller (having the protuberances) or the female roller (containing the recesses). However from a practical viewpoint, it is likely to be less expensive to manufacture the female roller from rubber as this will generally require the removal of less material in the laser engraving process. The present invention may be easily implemented on older embossing equipment as the only change required is the replacement of one of the rollers in each embossing pair. The embossing roller's drive equipment, roller diameters and lengths as well as spacing will all remain unchanged. Furthermore, the size and type of the individual embossing elements are not limited by the present invention as both micro embossing and macro embossing of fibrous webs can be undertaken.

The present invention is applicable as well to the updating of older embossing machinery having matched steel rollers. One of each of the matched pair of rollers can be removed, and by the laser reading and burning process described above, a new soft roller can be created to match the steel roller which may then be installed in the embossing equipment. In this manner older equipment otherwise unsuitable for the embossing of recycled material can be utilized to carry out the present invention thus extending the useful life of the equipment.

The present invention is also applicable to embossing machinery using unmatched rollers in which one of the rollers is replaced by a soft roller having the hardness parameters set forth above. Finally, the use of two matched soft rollers having a Shore A (durometer) hardness of 40–65 and a Shore A hardness of 60 and preferably of about 80 could also be used to emboss recycled pulp without damage frown contaminants in accordance with the present invention.

The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A method for embossing a fibrous web incorporating recycled pulp containing contaminants to improve the bulk and softness of the web by passing the web through a nip formed by a pair of rotating rollers, wherein the contaminants will not damage the rollers, the method comprising:

a) providing a first embossing roller having an outer surface, said outer surface having a plurality of male protuberances thereon corresponding to a desired embossed pattern;

b) providing a second embossing roll having an outer surface having a plurality of female recessed portions which are matched to the male protuberances of the first roll;

c) wherein one of said first and second embossing rollers has a Shore A hardness of 40–65 and the other roller has a Shore A hardness of at least about 90; and d) placing the rolls in contact to form a nip between the rolls, with the protuberances of the first roll entering the recesses of the second roll as the rolls rotate together; and passing the fibrous web incorporating recycled pulp constraining contaminants—has been inserted before the word "through"; through the nip formed by the rolls to emboss the web wherein the roller having the Shore A hardness of 40–65 will deform when any contaminants are encountered in the fibrous web such that a fibrous web including recycled pulp containing contaminant will be embossed without causing excess wear or damage to the embossing rollers.

2. The method of claim 1, wherein the step of providing a second roller includes utilizing a laser to form the recesses in the second roll, by removing portions of the material from the outer surface.

3. The method of claim 1, wherein the roller having a Shore A hardness of 40–65 comprises material selected from the group consisting of natural rubber, synthetic rubber and plastic.

4. The method of claim 1, wherein the roller having a Shore A hardness of at least about 90 is constructed of steel.

5. The method according to claim 1, wherein the contaminants in the recycled pulp include stickies.

6. A method for embossing a fibrous web incorporating recycled pulp containing contaminants to improve the bulk and softness of the web by passing the web through a nip formed by a pair of rotating rollers, wherein the contaminants will not damage the rollers, the method comprising:

a) providing a first embossing roller having an outer surface, said outer surface having a plurality of male protuberances thereon corresponding to a desired embossed pattern;

b) providing a second embossing roll having an outer surface having a plurality of female recessed portions which are matched to the male protuberances of the first roll;

c) wherein at least one of said first and second embossing rollers is a laser engraved roller and has a Shore A hardness of from about 40 to about 65; and d) placing the rolls in contact to form a nip between the rolls, with the protuberances of the first roll entering the recesses of the second roll as the rolls rotate together; and passing the fibrous web incorporating recycled pulp containing contaminants—has been inserted before the word "through"; through the nip formed by the rolls to emboss the web wherein the roller having the Shore A hardness of from about 40 to about 65 will deform when any contaminants are encountered in the fibrous web such that a fibrous web including recycled pulp containing contaminants will be embossed without causing excess wear or damage to the embossing rollers.

7. The method according to claim 6, wherein the recycled pulp contains stickies.

* * * * *

UNITED STATES PATENT AND TRADEMARK OFFICE

CERTIFICATE OF CORRECTION

PATENT NO. : 6,792,851 B1
DATED : September 21, 2004
INVENTOR(S) : Galyn A. Schulz It is certified that error appears in the above-identified patent and that said Letters Patent is hereby corrected as shown below:

Title page,
Item [57], ABSTRACT,
Line 10, change "Shore A hardness of 50-65" to -- Shore A hardness of 40-65 --;

Column 1,
Line 52, insert -- of the -- after "clearances";

Column 2,
Line 6, change "of at least about 90" to -- "of at least about 90" --;
Line 20, change "nnmatched" to -- unmatched --;

Column 3,
Line 23, delete "is";
Line 36, delete "provided" and insert -- , -- after "24";

Column 4,
Line 10, insert -- surface -- after "outer";
Line 30, change "contaminants" to -- contaminants. -- and change "it" to -- It --;
Line 35, insert -- . -- after "plastic";
Line 36, change "it" to -- It --;

Column 5,
Line 12, change "frown" to -- from --; and

Column 6,
Line 35, delete "-has been inserted" before the word "through";".

Signed and Sealed this

Thirtieth Day of August, 2005

JON W. DUDAS
*Director of the United States Patent and Trademark Office*